US005890694A

United States Patent [19]

Possick

[11] Patent Number: 5,890,694

[45] Date of Patent: Apr. 6, 1999

[54] PRESSURE-SENSITIVE WRIST PAD USEABLE WITH A COMPUTER INPUT DEVICE

[76] Inventor: Amity Possick, 60 E. 12th St., New York, N.Y. 10003

[21] Appl. No.: 824,637

[22] Filed: Mar. 27, 1997

[51] Int. Cl.[6] ..... F61M 13/00

[52] U.S. Cl. ..... 248/550; 248/118

[58] Field of Search ..... 248/118, 118.1, 248/550, 918; 400/715; 340/541; 128/774, 782, 904

[56] References Cited

U.S. PATENT DOCUMENTS

| | | | |
|---|---|---|---|
| 240,939 | 5/1881 | Applegate | 340/541 |
| 425,143 | 4/1890 | Moran | 340/541 |
| 1,658,848 | 2/1928 | Kalikow | 340/541 |
| 3,582,935 | 6/1971 | Verhaeghe | 340/279 |
| 4,402,326 | 9/1983 | Okano | 128/774 |
| 4,509,527 | 4/1985 | Fraden | 128/671 |
| 4,858,620 | 8/1989 | Sugarman et al. | 128/774 |
| 5,183,230 | 2/1993 | Walker et al. | 248/118 |
| 5,193,925 | 3/1993 | Foulke | 400/715 |
| 5,275,174 | 1/1994 | Cook | 128/774 |
| 5,277,200 | 1/1994 | Kawazoe et al. | 128/774 |
| 5,425,378 | 6/1995 | Swezey et al. | 128/782 |
| 5,449,002 | 9/1995 | Goldman | 128/779 |
| 5,599,280 | 2/1997 | Wolden | 601/15 |
| 5,608,599 | 3/1997 | Goldman | 361/283.1 |

FOREIGN PATENT DOCUMENTS

| | | | |
|---|---|---|---|
| WO 92/07510 | 3/1992 | WIPO | 128/774 |
| WO 92/20279 | 11/1992 | WIPO | 128/774 |
| WO 93/21019 | 10/1993 | WIPO | 248/118.1 |

*Primary Examiner*—Ramon O. Ramirez
*Assistant Examiner*—Robert Lipcsik
*Attorney, Agent, or Firm*—Michael Ebert

[57] ABSTRACT

A pressure-sensitive wrist pad placeable in front of a keyboard or other input device associated with a computer, the pad serving to warn an operator when in the course of operating the keyboard, the wrists of his hands do not then hover above the pad but rest on the pad and therefore give rise to dorsiflexion and possible repetitive strain injury. To this end, the pad incorporates in its structure a switch which is caused to close only when wrist pressure is exerted thereon, the closed switch acting to apply power to a warning device generating an audible, visible or vibratory warning signal. This signal acts to induce the operator to assume a proper wrist position hovering above the pad thereby avoiding dorsiflexion. The pressure-sensitive switch is preferably formed by a membrane covering the pad, the membrane being composed of a flexible foam plastic core layer having an array of openings therein sandwiched between plastic facing films on each of whose inner surfaces is printed an electrically-conductive grid. The grids constitute the movable contacts of the switch which is closed when wrist pressure applied to the membrane compresses the foam plastic layer to bring the grids in contact with each other through the openings in the layer.

9 Claims, 2 Drawing Sheets

PRESSURE-SENSITIVE WRIST PAD USEABLE WITH A COMPUTER INPUT DEVICE

BACKGROUND OF INVENTION

1. Field of Invention

This invention relates generally to wrist pads associated with a keyboard or other computer input device, and more particularly to a wrist pad which incorporates a pressure-sensitive switch and serves to generate a warning signal when a wrist of the operator whose hand manipulates the input device applies pressure thereto.

2. Status of Prior Art

Repetitive strain injury (RSI) is defined in the text "Repetitive Strain Injury—A Computer Users' Guide" whose principal author is Dr. Emil Pascarelli, as a cumulative trauma disorder (CTD). This disorder stems from prolonged repetitive, forceful or awkward hand movements. When these hand movements are accompanied by poor posture as well as a heavy workload, the stage is then set for RSI, a serious injury that can cause pain, weakness, numbness or impairment of motor control.

According to the U.S. Department of Labor, RSI accounts for about 60 percent of all job-related injuries. The concern of the present invention is with RSI resulting from the manual operation of an input device associated with a computer, such as a keyboard or a mouse.

A computer keyboard functions to enter alpha-numerical data into the computer. A mouse is a hand-held, button-operated input device which when rolled along a flat surface, then directs a cursor to move correspondingly about a computer screen, thereby allowing the operator to select particular operations or manipulate text and graphics. It is predicted that in the year 2000, three quarters of all jobs in the United States will probably require the use of a computer. It is for this reason that public schools throughout the country are now teaching students how to operate computers. It is an almost universal practice among computer users, when operating a keyboard or mouse, to rest the wrists of the hands on the edge of the work surface on which the input device is placed, or on a cushioned wrist pad in front of the keyboard or mouse.

Wrist supporting pads for computer operators give rise to dorsiflexion. Dorsiflexion refers to a hand bending upwardly at the wrist. Continual dorsiflexion which takes place when typing with the wrist resting on a wrist pad is a recognized major cause of RSI. Most computer guides therefore instruct operators to assume a proper typing posture by having the wrists float above the wrist pad and to rest the wrists only while not typing. But while this wrist posture is recommended by computer guides, no means have heretofore been available to facilitate proper wrist posture.

The 1995 patent to Hart U.S. Pat. No. 5,445,349 discloses a wrist rest formed by a cloth sack filled with rice. This sack is engaged by the wrist of an operator typing on a computer keyboard to relieve the physical stress occasioned by this activity. The 1994 patent to Martin et al. U.S. Pat. No. 5,340,067 discloses a cushioned pad for supporting the wrist of a computer mouse operator. In both of these patents, dorsiflexion takes place, and these wrist rests with continued use are therefore likely to give rise to RSI.

The 1989 U.S. Pat. No. 4,807,642 to Brown calls attention to musculoskeletal pain resulting from RSI and its serious consequences. Brown provides a monitoring device for detecting muscle strain which might lead to RSI. This monitoring device supplies the worker with biofeedback, serving to induce the worker to try out different work methods and thereby determine which one of these methods produces the least amount of tension. But Brown fails to recognize the role of proper wrist posture in operating a computer input device, and he discloses no means to induce a worker to maintain a proper wrist posture.

The 1994 Daneshvar U.S. Pat. No. 5,374,018 illustrates a soft pad for a computer keyboard adapted to support the palm or wrist of the operator. As previously noted, a pad on which an operator rests his wrists as he types on a keyboard with his hands result in dorsiflexion, and this may in time lead to repetitive strain injury.

Conner in his 1992 U.S. Pat. No. 5,165,630 provides a pad for a computer mouse which serves to elevate the wrist of the operator to reduce stress on the tendons controlling the wrist and hand. But as pointed out above, the ideal posture for the wrist of the user of a computer input device is one in which the wrist floats or hovers above a wrist pad, and makes no contact therewith. This is not achieved by the Conner pad.

Inasmuch as the invention resides in a pressure-sensitive wrist pad for use with a computer input device to provide a warning signal only when the wrist of an operator presses against the pad, of prior art background interest is the 1989 patent to Sugarman U.S. Pat. No. 4,858,620. This patent discloses a warning system that includes pressure sensors to sense the pressure of a foot against a cast and to provide a warning signal when this pressure reaches a dangerous level. The 1985 Kress U.S. Pat. No. 4,554,930 provides pressure sensors for measuring the pressure between the skin and a rest surface, which pressure, if excessive, may cause ulcers.

SUMMARY OF INVENTION

In view of the foregoing, the main object of this invention is to provide a pressure-sensitive pad adapted to be placed in front of a keyboard or other computer input device to warn an operator when in the course of operating the input device, the wrists of his hands make contact with the pad, this being indicative of an improper wrist posture.

A significant advantage of a pad in accordance with the invention is that it induces an operator, warned by the pad, to maintain his wrists so that they hover above the pad and thereby avoid dorsiflexion, the major cause of repetitive strain injury. Thus the operator need not look to see where his wrists are positioned, for he is instantly warned whenever they are improperly positioned, and is therefore taught to coordinate his wrist position with that of the pad.

More specifically, an object of this invention is to provide a pressure-sensitive pad which incorporates in its structure a switch that closes only when wrist pressure is applied to the pad, the closed switch acting to supply power to an apparatus generating a warning signal.

Also an object of this invention is to provide a pressure-sensitive pad which may be mass produced at relatively low cost.

Briefly stated, these objects are attained by a pressure-sensitive wrist pad placeable in front of a keyboard or other input device associated with a computer, the pad serving to warn an operator when in the course of operating the keyboard the wrists of his hands do not then hover above the pad but rest on the pad and therefore give rise to dorsiflexion and possible repetitive strain injury.

To this end, the pad incorporates in its structure a switch which is caused to close only when wrist pressure is exerted thereon. The closed switch acting to apply power to apparatus generating an audible, visible or vibratory warning signal which induces the operator by a warning device to assume a proper wrist position hovering above the pad.

The pressure-sensitive switch is preferably formed by a membrane covering the pad, the membrane being composed of a flexible foam plastic core layer having an array of openings therein sandwiched between plastic facing films on each of whose inner surfaces is printed an electrically-conductive grid. The grids constitute the movable contacts of the switch which is closed when wrist pressure applied to the membrane compresses the foam plastic layer to bring the grids in contact with each other through the openings in the layer.

BRIEF DESCRIPTION OF DRAWING

For a better understanding of the invention, as well as other objects and further features thereof, reference is made to the following detailed description to be read in conjunction with the accompanying drawing, wherein.

DETAILED DESCRIPTION OF INVENTION

The Wrist Pad

Figure 1:
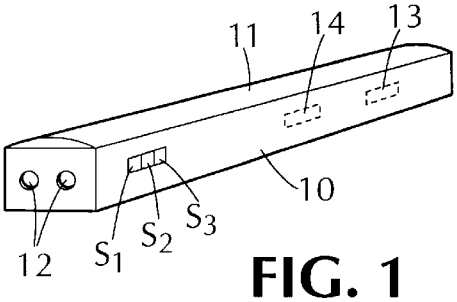
FIG. 1 is a perspective view of a pressure-sensitive wrist pad in accordance with the invention.

Referring now to FIG. 1, it will be seen that a wrist pad in accordance with the invention takes the form of a rectangular box 10 housing warning signal devices, the box being covered by a convex membrane 11 extending along the length of the box functioning as a pressure-sensitive switch.

LED's 12 are mounted at one end of box 10 to produce a warning signal in the form of intense light flashes. Housed in box 10 is a buzzer or beeper 13 for producing an audible warning signal as well as a vibrator 14 adapted to vibrate membrane 11 and thereby produce warning vibrations which are sensed by the wrist of the operator engaging the membrane. Warning devices 13 and 14 are represented in FIG. 1 by dashed-line blocks.

Figure 2:
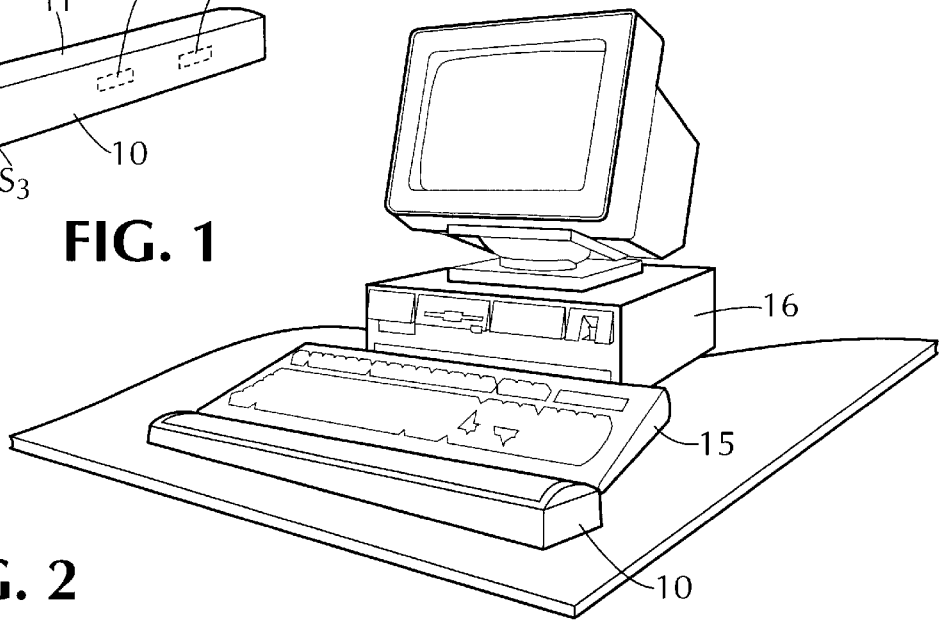
FIG. 2 shows the wrist pad in front of a computer keyboard.
Figure 3:
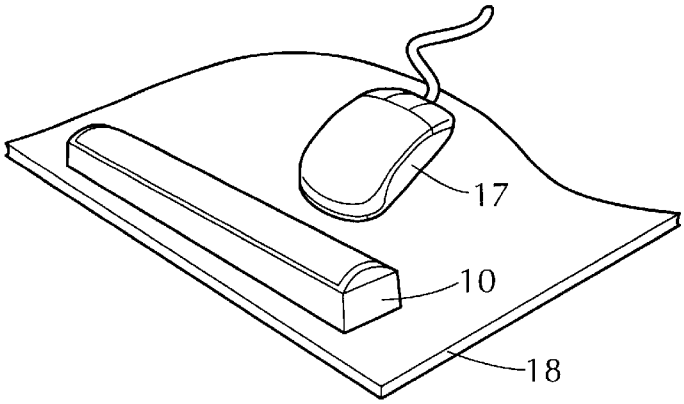
FIG. 3 illustrates the wrist pad in front of a computer mouse.

The wrist pad 10, when placed in front of a keyboard 15 associated with a computer 16 mounted on a desk or work surface 18, as shown in FIG. 2, or in front of a mouse 17, as shown in FIG. 3, also associated with this computer, serves to warn an operator in the course of operating the keyboard or mouse that his wrists are improperly positioned with respect to the wrist pad.

Figure 4:
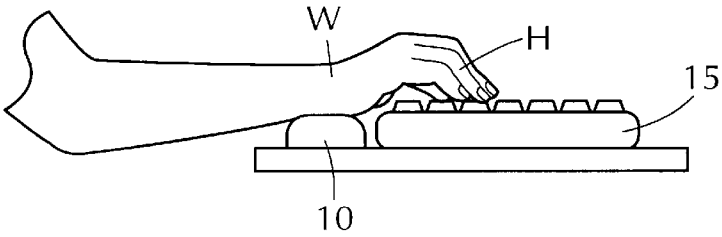
FIG. 4 shows an operator typing on the keyboard, the wrist of the operator's hand pressing against the wrist pad.
Figure 5:
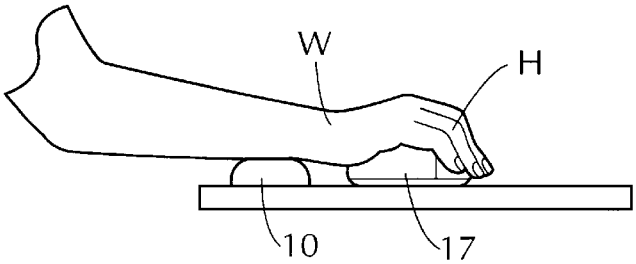
FIG. 5 shows an operator manipulating the mouse, the wrist of the operator then pressing against the wrist pad.

If the wrist W of an operator whose hand H when typing on the keyboard, as shown in FIG. 4, engages wrist pad 10, this wrist posture gives rise to dorsiflexion, for hand H, then bends upwardly at wrist W. This is also true when, as shown in FIG. 5, wrist W rests on pad 10 while hand H is manipulating mouse 17. As previously noted, continual dorsiflexion is a major cause of RSI. Hence the primary function of wrist pad 10 is to generate a warning signal which alerts the operator to the fact that his wrist position is improper and that he should therefore immediately raise the wrist so that it hovers or floats above the wrist pad.

It is to be noted in FIG. 2, that the length of wrist pad 10 matches that of keyboard 15. Hence regardless of where the operator types on the keyboard, such as in the central region or on either side thereof, the wrist pad is always below the wrists of the operator. In FIG. 3, the elongated wrist pad 10 remains operative regardless of the position of mouse 17 which is movable on flat surface 18 in a region encompassed by the pad.

Figure 6:
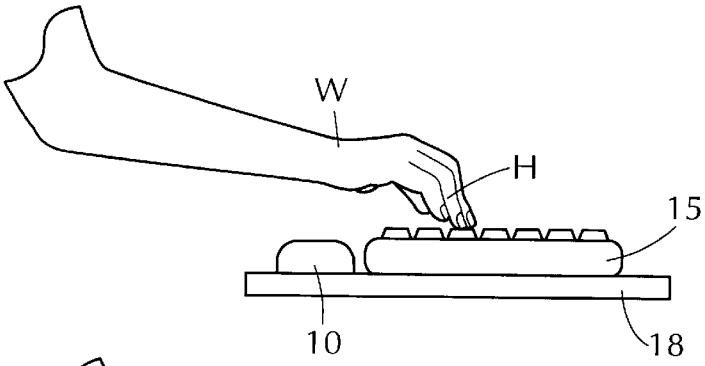
FIG. 6 is the same as FIG. 4 except that the wrist of the operator of the keyboard now floats above the wrist pad.
Figure 7:
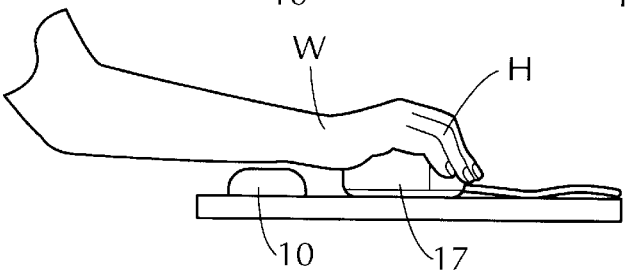
FIG. 7 is the same as FIG. 5 except that the wrist of the operator of the mouse now floats above the wrist pad.

It is vital in order to avoid repetitive strain injury (RSI) that an operator in the course of operating a computer input device with his hands so position his wrists that the hands do not then bend upwardly at the wrists for such dorsiflexion, if continued, will lead to RSI and therefore have serious consequences. The proper wrist position with respect to wrist pad 10 is shown in FIG. 6 where it will be seen that as hand H of an operator types on computer keyboard 15, wrist W then floats above wrist pad 10. In this wrist posture, hand H does not bend upwardly at the wrist. And in FIG. 7 which illustrates the hand of the operator manipulating mouse 17, it will be seen that wrist W then hovers above the pad and thereby avoids dorsiflexion.

Thus when operating a computer input device, the desirable wrist posture is one in which the wrist hovers above the pad, about ½ inch from its upper surface. The main function of pad 10 is to set off a warning signal whenever in the course of operation the wrist makes contact with the pad and is therefore improperly positioned. This warning signal alerts the operator and induces him to immediately correct his wrist position so that the wrist floats above the pad to a degree where the hand of the operator extends forwardly from the wrist without bending upwardly.

Pad 10 does however have a secondary function, for when the operator is not typing on the computer keyboard or manipulating a mouse, the operator can then rest has wrists on the pad and relax in preparation for resuming work.

In this quiescent state of the pad, the warning devices are turned off.

The Membrane

Membrane 11 which covers the box of wrist pad 10 functions as a pressure-sensitive switch which is normally open and closes only when the pressure applied thereto by a wrist of the operator exceeds a predetermined minimal level.

Figure 8:
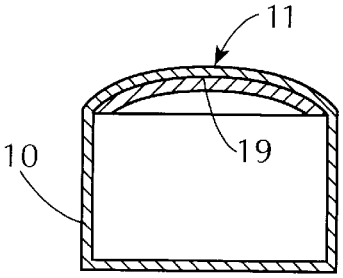
FIG. 8 is a transverse section taken through the pad.

As shown in FIG. 8, membrane 11 overlies a rigid arcuate backing 19.

Figure 10:
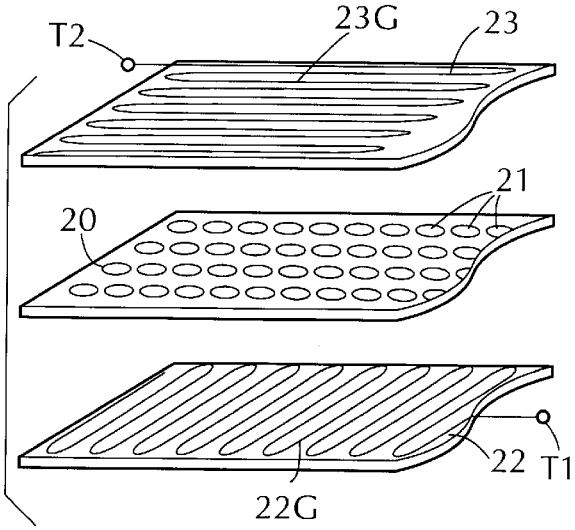
FIG. 10 is an exploded view of the components of the membrane.
Figure 9:
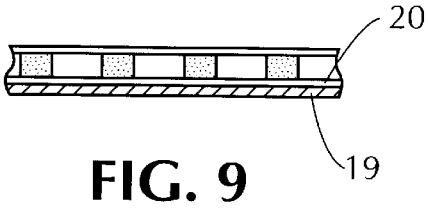
FIG. 9 is a section taken through the membrane covering the pad.

The membrane, as illustrated in FIGS. 9 and 10, is composed of a thin core layer 20 formed of flexible synthetic foam plastic material, such as urethane having an array of openings 21 therein uniformly distributed throughout the layer. Layer 20 is sandwiched between two facing films 22 and 23 formed of high-strength synthetic plastic material, such as bi-axially oriented Mylar (polyester) or polyethylene.

Printed on the underside of each film is an electrically-conductive metallic grid (22G and 23G) as in a printed circuit or on flexible plastic conductive leads. Grids 22G and 23G form movable contacts $T_1$ and $T_2$ of an electrical switch which is normally kept open by the foam plastic layer interposed between the grids.

When however core layer 20 is compressed by wrist pressure applied to the membrane by an operator of a computer input device, grids 22G and 23G then make contact with each other through reduced openings 21 in the core layer, thereby closing the switch.

Figure 11:
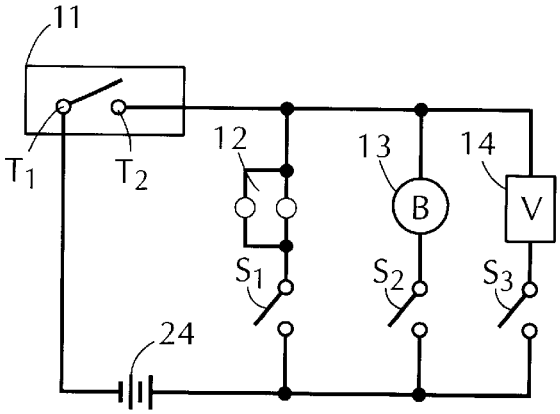
FIG. 11 is a circuit diagram of the apparatus in the wrist pad for generating a visual, audible or vibratory warning signal.

In the wrist pad circuit, as shown in FIG. 11, it will be seen that membrane switch 11 having movable contacts $T_1$ and $T_2$ which are normally disengaged from each other is connected in series with a battery 24 to apply power selectively to LED's 12, to the buzzer or beeper 13, and to the vibrator 14. Each of these warning devices has its own control switch ($S_1$, $S_2$ and $S_3$), so that the device is operative only when its control switch is closed.

The operator may choose whichever form of warning signal is best suited to his needs. Thus the operator may prefer to be alerted by light-flashes produced by LED's 12, for these quickly alert the operator to the fact that his wrists are improperly positioned and must therefore be raised above the pad to avoid dorsiflexion. To produce strobe-like flashes, rather than a steady light, voltage from battery 24 is applied to the LED's when the membrane switch is closed through an electronic blinker (not shown) which pulse-activates LED's 12.

An operator may however prefer an audible warning signal in the form of the repetitive beeps produced by beeper 13, for these are capable of eliciting a fast reaction. An operator is inherently more responsive to repetitive beeper sounds than to a continuous tone.

Should the operator wish not to be distracted by an audible or visual warning signal, he may elect to be alerted to an improper wrist position by vibrations produced by vibrator 14 which he senses through his wrists when engaging the membrane. Vibrator 14 may take the form of an electromagnetic vibrator of the type incorporated in battery operated electric shavers in which the cutting head is reciprocated by the vibrator.

When used in pad 10, the vibrating element of the vibrator is mechanically coupled to backing 19 underlying the membrane, the vibrations being conveyed through the membrane to the wrist engaging the membrane.

The membrane switch may in practice take other forms, such as a pair of superposed thin flexible metal plates and a thin layer of flexible foam plastic material having openings therein interposed between the plates which function as the contacts of the switch. The nature of the membrane switch must be such that it is closed regardless of where wrist pressure is applied thereto. Thus if the wrist engages one end of the membrane, the center of the membrane or a point between the center and one end, in all these instances the switch will close.

The drawback to wrist pads in common use in conjunction with computer input devices is that they act as rests or cushions for the wrists of the operator. While the operator in the course of operating a computer input device by then resting his wrists on a wrist pad may enjoy a release of muscular tension, this release is not beneficial, for by resting his wrists on the pad, the resultant dorsiflexion may in time produce RSI.

The significant advantage of a pressure-sensitive wrist pad in accordance with the invention is that in its active mode when the operator is working a computer input device, the operator is induced by warning signals to position his wrists so that they hover above the pad and therefore avoid dorsiflexion. But in its inactive mode in which the warning devices are disabled, the pad functions as a wrist rest for the operator in the intervals when the operator is not working the computer. In practice, a foot switch may be associated with the wrist pad whereby the operator can with his foot turn off the warning device in the pad so that it then functions in an inactive mode.

Modifications

Though dorsiflexion accounts for most repetitive strain injuries, such injuries can also arise when users repeatedly rest their wrists and hands while operating a computer input device without assuming a dorsiflexion posture. Thus many mouse users improvise a wrist rest to equal the height of the mouse and then rest their hands and wrists thereon as they work.

It has been found that by so resting the wrists and hands one may experience RSI even in the absence of dorsiflexion. In time this may cause compressed nerves and isolate finger and hand muscles from arm muscles, conditions which are conducive to RSI. Thus it is not uncommon for a computer keyboard operator to avoid fatigue by resting the heel of his hand on the edge of a desk as he reaches with his fingers for the keys.

A wrist pad in accordance with the invention when placed in front of a computer input device can produce a warning signal should the operator's wrist or hands make contact with the pad regardless of whether there is then dorsiflexion.

It is not essential to the invention that the wrist pad be a self-sufficient device independent of the computer input device. In practice, the pad may be connected to the computer keyboard or mouse with which it is associated. In this way the wrist pad is rendered active only when the computer input device is operative.

Thus interconnection of the input device with the wrist pad allows a user to rest his wrists or hands on the pad during breaks. When the user resumes work on the keyboard or mouse, the wrist pad is then automatically reactivated to provide a warning signal when the user contacts the pad with his wrists or hands.

When the wrist pad is hooked up with the input device of a computer, it need not then itself produce a warning signal, for the computer or a monitor or terminal associated therewith may be arranged to produce an audible or visible warning signal when the wrists or the hands of a user of the input device make contact with the pad.

Also in practice, the wrist pad could be physically integrated with the computer input device. Thus in the case of a computer keyboard, the wrist pad would be incorporated in the front wall of the keyboard frame.

Many computer operators spend several hours a day at a keyboard or mouse without taking a break. Even if the operator avoids dorsiflexion, the muscular strain resulting from prolonged operation may have adverse effects.

A wrist pad in accordance with the invention may include a settable timer which after a predetermined period notifies the operator by means of an electronic chime or other signal, that it is time to take a short break.

In a wrist pad in accordance with the invention, a warning signal is generated only when pressure applied by the wrist or hands of the operator onto the membrane of the pad is sufficient to close the switch.

It may not be desirable to have an arrangement in which a light pressure applied to the membrane is sufficient to close the switch. While specialists generally believe that computer users should always avoid resting their wrists or hands when operating a computer input device, many occupational therapists regard this requirement as unduly severe. It is very difficult for a typical user to change abruptly from an incorrect to a correct wrist and hand posture, for to do so demands substantial upper body strength as well as endurance and determination to maintain at all times the correct posture while working at the computer.

It may therefore be desirable to introduce a degree of tolerance in the wrist pad, causing the switch to be closed to activate the warning device only when the pressure applied to the membrane exceeds a given threshold level.

In that way the user, as he operates a computer input device, is free to glide his wrists back and forth along the membrane of the wrist pad, and as long as he is not exerting a substantial pressure thereon, the switch will not close to activate the warning signal.

Hence by reducing the sensitivity of the wrist pad, the user of the computer input device is only warned when his wrist or hand position is grossly incorrect. This affords the user with a transitional learning period during which he proceeds to improve his posture until a point is reached where he ceases altogether to make even light contact with the membrane or cover of the pad.

In practice therefore, a pressure-sensitive switch may be provided that includes means for adjusting the degree of pressure required to operate the switch. The sensitivity of the switch can therefore be adjusted to accommodate the needs of a particular user of the computer input device.

While there has been shown and described preferred embodiments of a pressure-sensitive wrist pad useable with a computer input device in accordance with the invention, it will be appreciated that many changes may be made thereon within the spirit of the invention.

I claim:

1. A pressure-sensitive wrist pad placeable in front of a computer input device constituted by a keyboard having a predetermined length operated by the hands of an operator, said pad comprising:

A. an elongated box having a length substantially the same as of that said keyboard and placeable adjacent said keyboard, said box housing a battery and at least one warning device which when powered by the battery, generates an audible warning signal; and B. a non-cushioning cover incorporating a normally-open pressure-sensitive switch covering the box, said switch connecting the battery to the warning device when the cover is momentarily pressed by a wrist of the operator whereby the warning device then generates an audible warning signal inducing the operator to raise the wrist so that it hovers over the pad and thereby avoids dorsiflexion and possible repetitive strain injury.

2. A pad as set forth in claim 1, in which said warning device is adapted to generate a visible light warning signal.

3. A pad as set forth in claim 2, in which the warning device includes at least one LED.

4. A pad as set forth in claim 2, in which the battery is connected to the LED when the switch is closed through an electronic blinker which causes the LED to emit periodic light flashes.

5. A pad as set forth in claim 1, in which the warning device is an electrically powered beeper.

6. A pad as set forth in claim 1, in which the warning device is an electrically powered vibrator coupled to the cover to produce vibrations that are sensed by the wrist engaging the cover.

7. A pad as in claim 1, further including a manually-operated control switch in series with the warning device to render it inactive when the control switch is open.

8. A pad as set forth in claim 1, in which the cover is a membrane having a core layer of flexible foam material having an array of openings thereon sandwiched between plastic facing films on whose inner surfaces are printed conductive grids defining the contacts of the switch.

9. A pressure-sensitive wrist pad as set forth in claim 1, in which the pressure-sensitive switch has a sensitivity such that it takes a pressure higher than a light pressure applied to said cover to close said switch.

* * * * *